US005096238A

United States Patent [19]

Mintz

[11] Patent Number: 5,096,238

[45] Date of Patent: Mar. 17, 1992

[54] SECONDARY DOOR LOCKING SYSTEM

[76] Inventor: Shalom A. Mintz, 8416 El Arroyo Dr., Huntington Beach, Calif. 92647

[21] Appl. No.: 615,383

[22] Filed: Nov. 19, 1990

[51] Int. Cl.[5] ..... E05C 1/06

[52] U.S. Cl. ..... 292/35

[58] Field of Search ..... 292/34, 35, 39, 166, 292/167, 337; 49/395

[56] References Cited

U.S. PATENT DOCUMENTS

| | | | |
|---|---|---|---|
| 824,545 | 6/1906 | Hubermann | 292/35 X |
| 1,513,835 | 11/1924 | Lovell | 292/35 |
| 3,970,340 | 7/1976 | Taft | 292/300 |
| 4,046,410 | 9/1977 | Connell | 292/36 |
| 4,288,944 | 9/1981 | Donovan | 292/39 |
| 4,534,192 | 8/1985 | Harshbarger et al. | 70/118 |
| 4,823,510 | 4/1989 | Amos | 49/383 |

FOREIGN PATENT DOCUMENTS

| | | | |
|---|---|---|---|
| 2378160 | 8/1978 | France | 292/35 |
| 2051214A | 1/1981 | United Kingdom | 292/35 |

*Primary Examiner*—Richard E. Moore

[57] ABSTRACT

A locking system for a door for use in conjunction with a commonly available locking mechanism has an interconnecting rod attached to one end of the primary sliding bolt of the locking mechanism, and at the other end to a pivoted link. A draw bar extends from the pivoted link to other pivoted links that are each attached to an additional sliding bolt. As the primary sliding bolt is extended outwardly from the edge of the door via the locking mechanism, the interconnecting rod communicates this motion via the pivoted links and draw bar to each of the other sliding bolts, thereby causing these sliding bolts to extend from the edge of the door in a like manner. Similarly, as the primary sliding bolt is retracted, the reverse process occurs and the secondary sliding bolts retract into the edge of the door. As this system ultilizes a pre-existing locking mechanism mounted in a standard location on the door, a conventional door locking mechanism augmented by the secondary locking system of the present invention becomes strengthened while advantageously remaining inconspicuous.

4 Claims, 3 Drawing Sheets

SECONDARY DOOR LOCKING SYSTEM

FIELD OF THE INVENTION

This invention relates to door locking systems. More specifically, this invention relates to secondary door locking systems of the multiple bolt type.

BACKGROUND OF THE INVENTION

A typical door locking system comprises a door, a door frame, hinges securing a first edge of the door to the door frame, and a locking mechanism that, when in the locked position, employs a sliding bolt to secure a second, opposite edge of the door to the door frame. Such a door locking system is generally weakest in the areas where the door and door frame are attached via hinges or sliding bolts.

Many devices have been developed that increase the strength of such door locking systems. Some of these devices are designed to reinforce the primary locking system. For example, locking mechanisms and hinges can be mounted on metallic plates that dissipate excessive force applied to these areas over a larger portion of the door or door frame, thereby strengthening the door locking system.

Other such locking systems use a multiplicity of security bolts. In most of these systems, additional sliding bolts emerge from various edges of the door to engage the door frame, providing more contact points between the door and frame, and thereby strengthening the door locking system.

A substantial drawback to both reinforcing plates and current multiple sliding bolt locking systems is that they are conspicuous. Reinforcing metallic plates are typically mounted on both sides of the door, and multiple sliding bolt mechanisms require a unique linkage and doorknob housing typically located in the center of the door. Further, large bolts and other heavy fasteners are common with such locking systems. Such conspicuous security mechanisms often stir undesirable curiosity and promote break-in attempts that otherwise would not occur.

Moreover, current multiple sliding bolt locking systems are complex, primary mechanisms that require a unique linkage and doorknob housing. Design and manufacturing costs, consequently, are higher than those of a secondary locking system that relies on a primary, commonly available locking mechanism that is easily modified.

SUMMARY OF THE INVENTION

The present invention is an improved locking system comprising a multiplicity of sliding bolts common in movement to a primary sliding bolt of a commonly available locking mechanism. An interconnecting rod is attached to one end of the primary sliding bolt, and at other end to a pivoted link. A draw bar extends from the pivoted link to other pivoted links that are each attached to an additional sliding bolt. When the primary locking bolt is extended outward from the edge of the door via the locking mechanism, the interconnecting rod communicates this motion via the pivoted links and draw bar to each of the other sliding bolts, causing these sliding bolts to extend from the edge of the door in a similar fashion. Similarly, as the primary sliding bolt is retracted, the reverse process occurs and the secondary sliding bolts retract into the edge of the door.

To further strengthen the door locking system, a plurality of fixed bolts are mounted on the hinged first edge of the door and each engages a corresponding recess in the door frame when the door is closed.

As the primary locking mechanism is a standard part and the remaining components of this system are contained out of sight within the door, this secondary locking system is inconspicuous and will not give rise to unnecessary curiosity. Further, it is not complex in design and therefore is relatively inexpensive to manufacture.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE INVENTION

Figure 1:
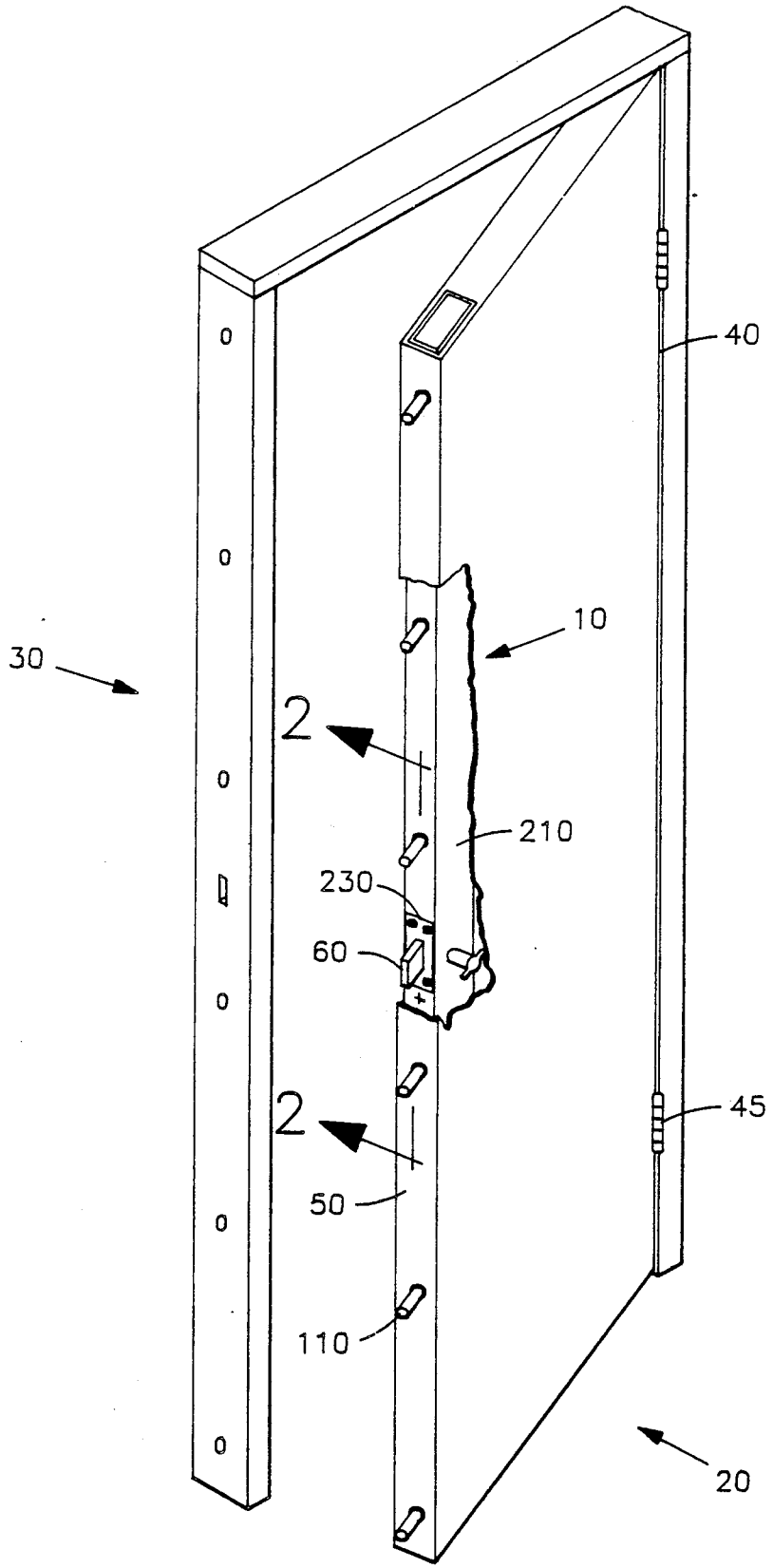
FIG. 1 is a perspective cut-away view of the embodiment of the invention of claim 6, illustrating a first edge of a door having a primary sliding bolt and a plurality of secondary sliding bolts extending therefrom; with said door being cutaway to reveal an enclosure for housing elements of the invention.
Figure 3:
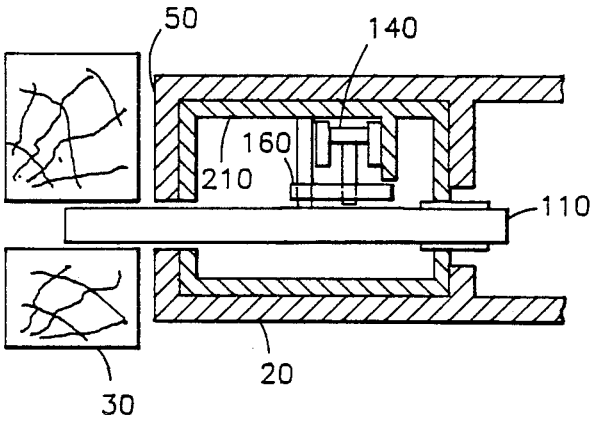
FIG. 3 is a cross-sectional view of the invention taken generally along lines 3—3 of FIG. 2; illustrating a secondary bolt attached to the draw bar by a link.
Figure 2:
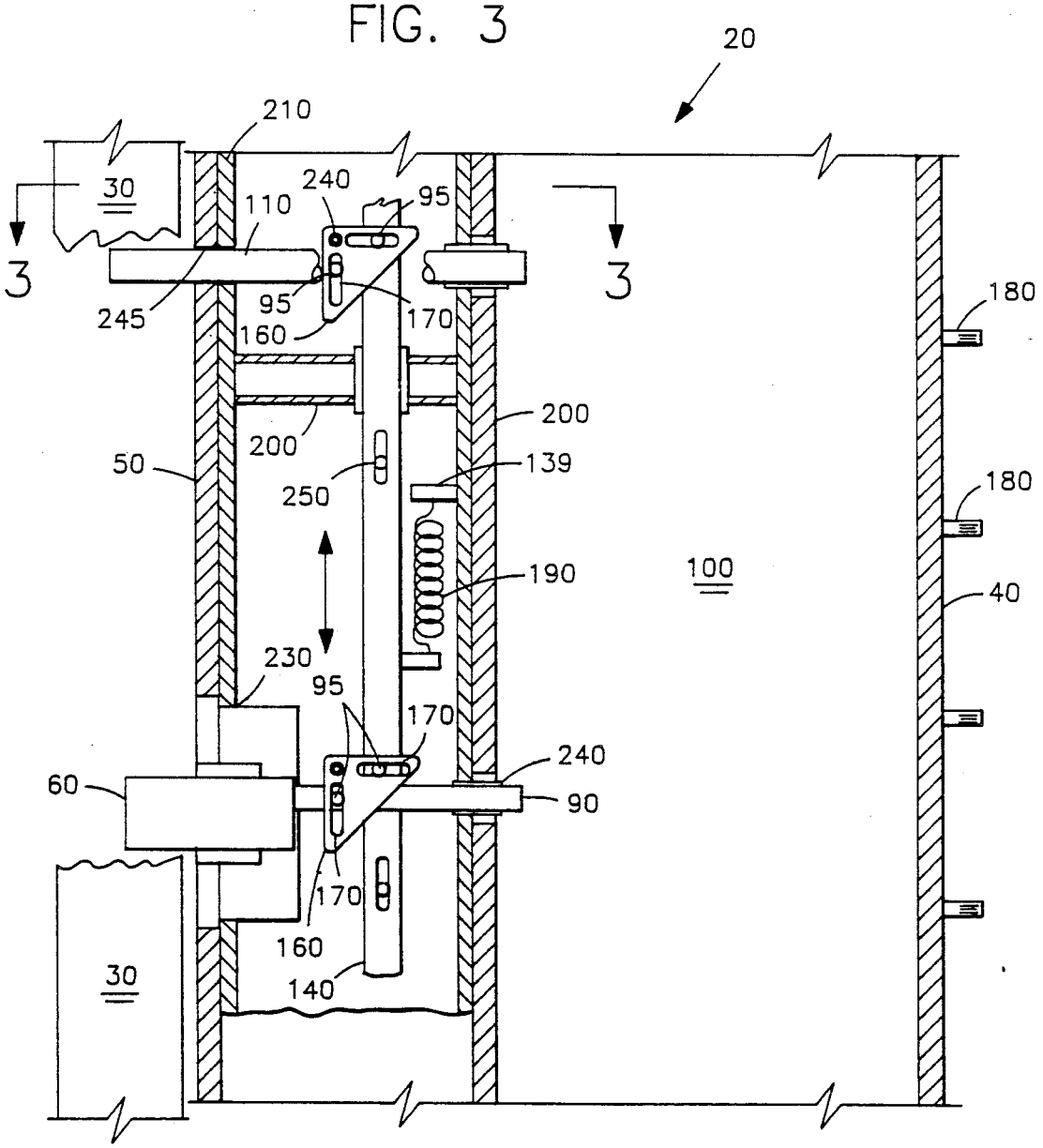
FIG. 2 is a cross-sectional view of the invention taken generally along lines 2—2 of FIG. 1, illustrating a draw bar attached to the primary bolt and to a secondary bolt by links, also showing a spring for counter balancing the weight of the draw bar.

FIGS. 1 and 2 illustrate one embodiment of a secondary locking system 10 for a combination door 20 and a door frame 30. A plurality of hinges 45 are mounted to the door frame 30 and a vertical edge 40 of the door 20. A primary bolt 60 is slidably retained within a channel (not visible) within a surface 50 of the door 20 and is capable of being positioned at an extended position 70 (FIG. 4) for engaging the door frame 30, as illustrated in FIGS. 1 and 2, or at a retracted position 80 for disengaging the door frame 30.

Figure 4:
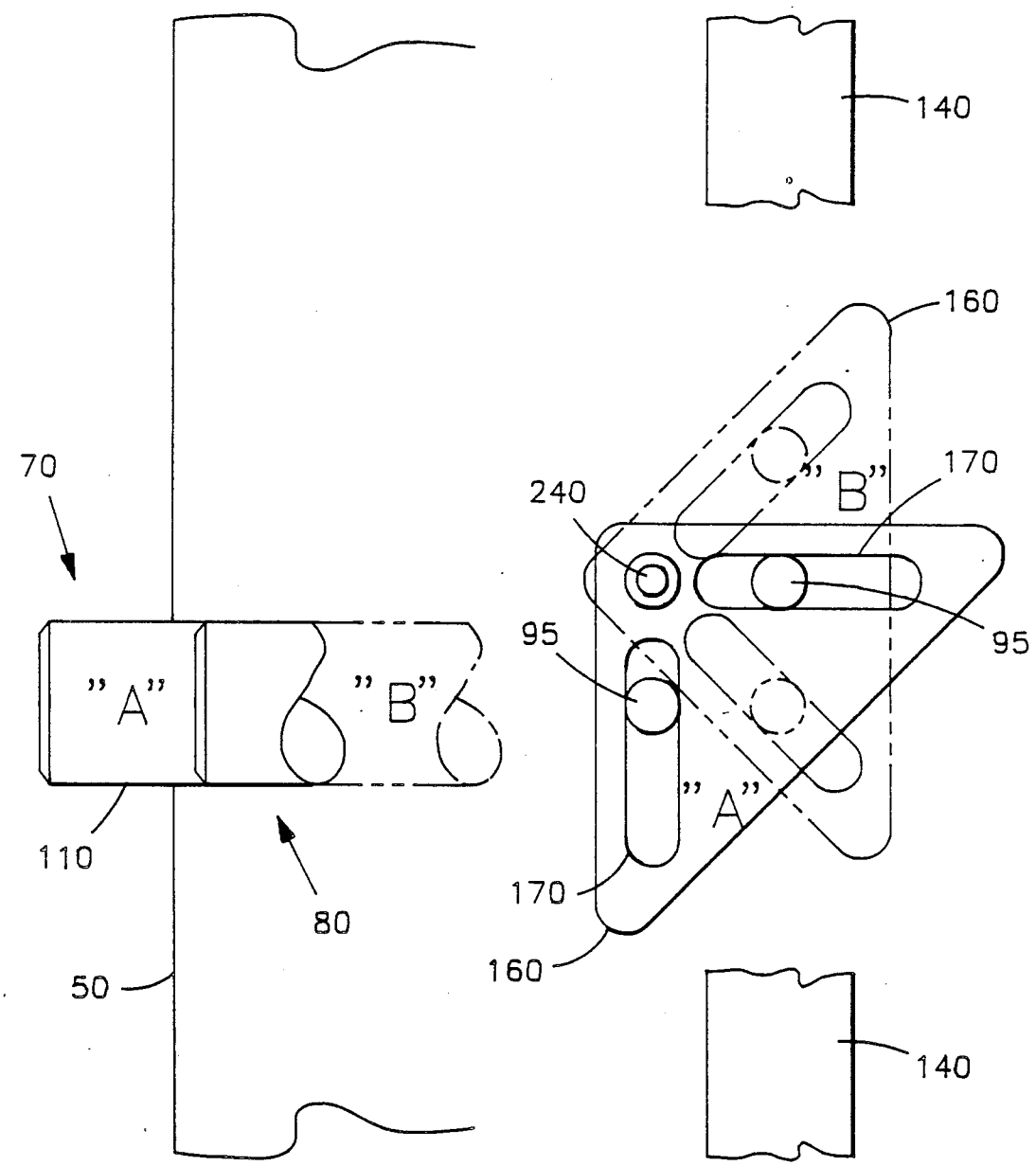
FIG. 4 is a cross-sectional view of a secondary bolt and link of the invention, illustrating the extended position "A" and also illustrating, in phantom outline, the retracted position "B" of the bolt and link.

An interconnecting rod 90 is attached to and is movable with the primary bolt 60. The interconnecting rod 90 has an engagement pin 95 for engaging one of a plurality of links 160. A plurality of secondary bolts 10 are slidably retained in the door 20, each secondary bolt 110 capable of being positioned in the extended position 70 for engaging the door frame 30, or the retracted position 80 for disengaging from the door frame 30. Each secondary bolt 110 has one engagement pin 95 for engaging one of the links 160. A draw bar 140, preferably of a generally flat profile, is slidably mounted in the door 20 and is constrained to linear sliding motion along a path parallel to the longitudinal axis of the door 20. A plurality of the engagement pins 95 protrude from the draw bar 140, each for engaging one link 160. FIG. 4 illustrates a configuration "A" of the secondary bolt 110, the link 160, and the draw bar 140 when the secondary bolt 110 is in the extended position 70. A configuration "B" of the secondary bolt 110 in the retracted position is also shown to illustrate the change in orientation undergone by the link 160 and the draw bar 140.

Each of the links 160 is pivotally mounted within the door 20, each link 160 constrained to rotational movement in a plane perpendicular to the surface 50 within the door 20 by a pivot pin 240. Two separate slots 170 are formed in the each link 160 for engagement with the engagement pins 95, each engagement pins 95 extending a considerable distance through a slot 170 so that the engagement pin 95 will not inadvertently disengage from the slot 170. The interconnecting rod 90 engages one link 160, the secondary bolts 110 each engaging one further link 160. The draw bar 140 engages all links 160.

In operation, when the primary bolt 60 is moved from the retracted position 80 to the extended position 70, the interconnecting rod 90 is linearly translated, causing the link 160 attached to the interconnecting rod 90 to rotate towards configuration "A" of FIG. 4, driving the draw bar 140 in translational motion to cause the remaining links 160 to rotate also towards configuration "A," thereby driving the secondary bolts 110 in linear translational motion to assume the extended position 70. In a like manner, when the primary bolt 60 is moved from the extended position 70 to the retracted position 80, the interconnecting rod 90, the links 160, and the draw bar 140 cooperate to bring the secondary bolts 110 into the retracted position 80 of configuration "B."

In one embodiment of the invention, the secondary bolts 110 are oriented primarily parallel to the primary sliding bolt 60, and the drawbar 140 is oriented relatively perpendicular to the primary sliding bolt 60.

In another embodiment of the invention, a plurality of fixed bolts 180 extend outwardly from the edge 40 of the door 20 to the door frame 30, the fixed bolts 180 engaging the door frame 30 when the door 20 is in the closed position. These fixed bolts 180 are illustrated in FIG. 2.

In yet another embodiment of the invention a coil spring 190, shown in FIG. 2, is stretched between a small extension 139 of the draw bar 140 and a door structure 200 fixed with respect to the door 20. When the draw bar 140 moves downward, the coil spring 190 is extended, thereby providing a balancing force to compensate for the weight of the draw bar 140.

In yet another embodiment of the invention, an enclosure 210 is provided for mounting the secondary locking system 10. The enclosure removably fits within the door 20 adjacent to its edge 50. The enclosure 210 has a primary bolt accepting means 230, preferably comprising an opening, and a mounting means 245 for the secondary bolts 110, preferably comprising openings in the enclosure 210 to receive the secondary bolts 110. The enclosure 210 also has pivot pins 240 for rotationally mounting the links 160, and constraining pins 250 for mounting and constraining the motion of the draw bar 140.

While specific embodiments of the invention have been described, it will be appreciated that many modifications thereof may be made by one skilled in the art that come within the true scope and spirit of the invention. Clearly, the components of the invention could be manufactured with a variety of materials, providing that these materials meet the strength requirements of the application in which the invention will be utilized. A wide variety of metal alloys and plastics are available that would accomplish the objectives of the invention. The invention could be modified to fit doors and doorways of a wide variety of shapes without significant impact to the overall performance of the invention. Any of several commonly available primary bolt 60 actuation apparati may be utilized, as well. Finally, a wide variety of conventional or custom made doors 20 may be used with the invention, since utilizing the invention with only a particular type of door 20 would potentially lessen the inconspicuousness of the invention. Thus, the scope of the invention is to be interpreted only in conjunction with the appended claims.

What is claimed is:

1. A secondary locking system in combination with a door and door frame, the door having a first edge for hingably mounting the door to the door frame and an opposing second edge including means for bolting the door to the door frame, said bolting means slidably supporting a primary bolt capable of being positioned at an extended position for engaging the door frame, and at a retracted position for disengaging the door frame, the secondary locking system comprising:

an interconnecting rod attached to, and movable with the primary bolt, the interconnecting rod having at least one engagement pin thereon;

a plurality of secondary bolts slidably retained within the door, each secondary bolt capable of being positioned at an extended position for engagement with the door frame, wherein the secondary bolts protrude from the second edge when at said extended position, said secondary bolts also capable of being positioned at a retracted position for disengagement from the door frame, each secondary bolt having at least one engagement pin thereon;

a draw bar slidably mounted in the door, and means for constraining said draw bar to linear sliding motion along a path substantially parallel to the longitudinal axis of said bar, the draw bar having a plurality of said engagement pins thereon; and a plurality of links and means for pivotally mounting said links within the door such that each link is constrained to rotational motion therein, each link having at least two separate means for slidable engagement with said engagement pins, the interconnecting rod engaging one link, the secondary bolts each engaging one further link, all links engaging the draw bar, whereby extending the primary bolt forces the interconnecting rod to linearly translate, causing the link attached thereto to rotate, driving the draw bar in translational motion thus causing the remaining links to rotate and thereby driving the secondary bolts in linear translational motion to assume the extended position, and in like manner, by forcing the primary bolt to the retracted position, secondary bolts retract as well;

the draw bar mounted with its longitudinal axis substantially vertically oriented, further comprising at least one spring having one end attached to the draw bar and an opposite end attached to an interior portion of the door, the spring being extended when the draw bar slides downward, thereby providing a balancing force to compensate for the weight of the draw bar.

2. The secondary locking system of claim 1 further including an enclosure, the enclosure defining a volumetric space for holding the secondary locking system, the enclosure engaging the door at the second edge to enable the primary and secondary bolts to be extended for locking the door, the enclosure and secondary locking system slidably removable from the door for replacement or maintainance.

3. The system of claim 2 wherein the enclosure in removable from the top and bottom of the door.

4. The system of claim 2 wherein the enclosure is removable from the second edge of the door.

* * * * *